United States Patent [19]

Gabrielson et al.

[11] 4,196,563

[45] Apr. 8, 1980

[54] ARRANGEMENT FOR FILLING A RECEPTACLE HAVING SELF-CONTAINED CLOSURE MEANS

[75] Inventors: Lyle G. Gabrielson, Menasha; Harvey J. Fenske, Fremont, both of Wis.

[73] Assignee: Menasha Corporation, Menasha, Wis.

[21] Appl. No.: 924,705

[22] Filed: Jul. 14, 1978

[51] Int. Cl.[2] ..... B65B 47/06

[52] U.S. Cl. ..... 53/456; 53/467; 53/491; 53/579; 53/207; 53/374

[58] Field of Search ..... 53/456, 458, 467, 491, 53/374, 376, 207, 579

[56] References Cited

U.S. PATENT DOCUMENTS

| | | | |
|---|---|---|---|
| 2,500,922 | 3/1950 | Berch | 53/579 X |
| 3,064,405 | 11/1962 | Gentry | 53/579 |

*Primary Examiner*—Travis S. McGehee

*Attorney, Agent, or Firm*—Andrus, Sceales, Starke & Sawall

[57] ABSTRACT

A receptacle is formed from an appropriately scored blank by mechanical folding and set-up prior to its being filled, and for mechanical closure of the self-contained cover members after the filling of the receptacle.

15 Claims, 17 Drawing Figures

ARRANGEMENT FOR FILLING A RECEPTACLE HAVING SELF-CONTAINED CLOSURE MEANS

NATURE AND SUMMARY OF THE INVENTION

This invention relates to an arrangement for forming a receptacle from a blank by mechanical set-up prior to the filling and for mechanical closure of the self-contained cover means after the filling of the receptacle. The receptacle is described and claimed in application Ser. No. 901,072, filed Apr. 28, 1978 and assigned to the common assignee of this invention.

The receptacle of application Ser. No. 901,072 has opposed end walls and opposed side walls normal to the end walls and is formed from a scored blank. The receptacle and its blank provide for self-contained closure means including a cover member having endwise extensions provided on each of the opposed sidewalls.

According to this invention, an arrangement is provided which includes means for folding the scored blank and setting up the receptacle with the cover members in open relation. The receptacle is presented to the fill station and is oriented with the side walls paralleling the subsequent direction of travel. First conveyor means are provided for moving the filled receptacle. Cover member fold-down means are spaced above and extend longitudinally of the first conveyor means for folding the opposed cover members down into receptacle closure position with travel of the receptacle on the first conveyor means. A second conveyor means are disposed normal to the first conveyor means and receives the receptacle from the first conveyor means with the cover members in closure position and oriented for travel on the second conveyor means with the end walls paralleling the direction of travel. Means are associated with said second conveyor means for locking the endwise extension on said cover members relative to the receptacle end walls to secure the cover members in closure position.

DESCRIPTION OF THE DRAWING FIGURES

The drawings furnished herewith illustrate the best mode presently contemplated for carrying out the invention and are described hereinafter.

In the drawings:

FIG. 9A is a partial perspective view showing the cover fold-down apparatus of the cover closure mechanism;

DESCRIPTION OF THE ILLUSTRATED EMBODIMENT

Figure 1:
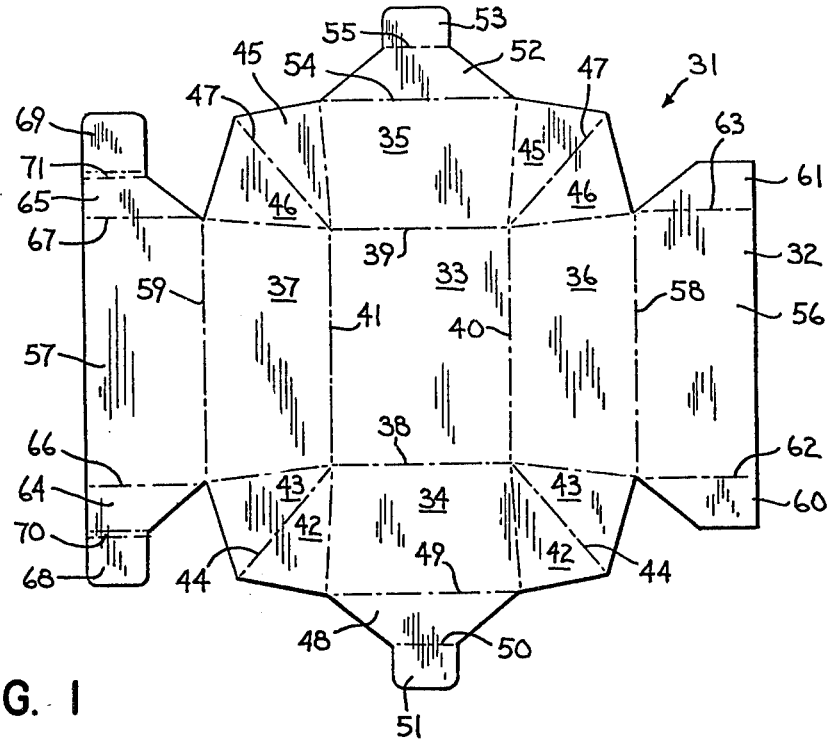
FIG. 1 is a plan view of a scored blank for a receptacle which is formed prior to being filled and closed after filling by the mechanism of this invention.

Referring to the drawings, the receptacle 30 having self-contained closure means results from the blank 31. The receptacle 30 lends itself to mechanical set-up prior to its being filled, and after filling, to mechanical closure by the mechanism generally shown in FIG. 8.

The mode of assembly for the receptacle 30 from blank 31 through closure is generally indicated in FIGS. 1–7 of the drawings. The blank 31 is stamped or cut, preferably from laminated paperboard, to provide that the grain of the paperboard will be parallel to the length dimension of the receptacle. The paperboard is faced with a silicone treated release paper to provide the receptacle with an inner lining 32 to assure later clean release of the contents without paper residue. The blank 31 is appropriately scored, as hereinafter described, for fold assembly of the receptacle 30.

The receptacle 30 comprises a bottom 33, forward wall 34, rear wall 35 and opposed side walls 36 and 37. At least the side walls 36 and 37 representing the length dimension of the receptacle 30 flare outwardly to provide a draft taper toward the top opening of the receptacle and thereby provide for easier removal of the contents.

Corresponding portions of the receptacle 30 are designated in the blank 31 of FIG. 1 with like reference numerals with the bottom portion 33 being separated from the forward wall portion 34 by the score lines 38, from the rear wall portion 35 by the score line 39, and from the opposed side wall portions 36 and 37 by the score lines 40 and 41, respectively. The blank 31 further includes front corner gusset portions 42 and 43 between the forward wall portion 34 and the respective side wall portions 36 and 37. Gusset portions 42 and 43 on each side of the forward wall portion 34 are separated by the score lines 44 which radiate from the forward corners formed between the bottom portion 33 and the respective side wall portions 36 and 37. Rear corner gusset portions 45 and 46 form a portion of the blank 31 between the rear wall portion 35 and the respective side wall portions 36 and 37. The gusset portions 45 and 46 to each side of the rear wall portion 35 are separated by the score lines 47 which radiate from the rear corners formed between the bottom portion 33 and the respective side wall portions 36 and 37.

The blank 31 also includes a projecting forward flap portion 48 separated from the front portion 34 by the score line 49. The flap projection 48 comprises generally a regular trapezoid having the score line 49 for its base and with the non-parallel sides tapering outwardly from the respective ends of the base to the score line 50 generally paralleling the base and separating a tab 51 from the balance of the flap projection. The rear wall portion 35 of blank 31 is similarly provided with the projecting rear flap portion 52 and tab 53 which are generally similar to the front flap projection 48 and tab 51. The rear flap projection 52 and tab 53 are defined by the score lines 54 and 55 respectively.

The blank 31 further includes opposed cover portions 56 and 57 which project outwardly from the respective side wall portions 36 and 37 and are separated therefrom by the corresponding score lines 58 and 59. Further detail in regard to the cover portions 56 and 57 and the mode of closure for the receptacle 30 will be treated hereinafter.

Figure 2:
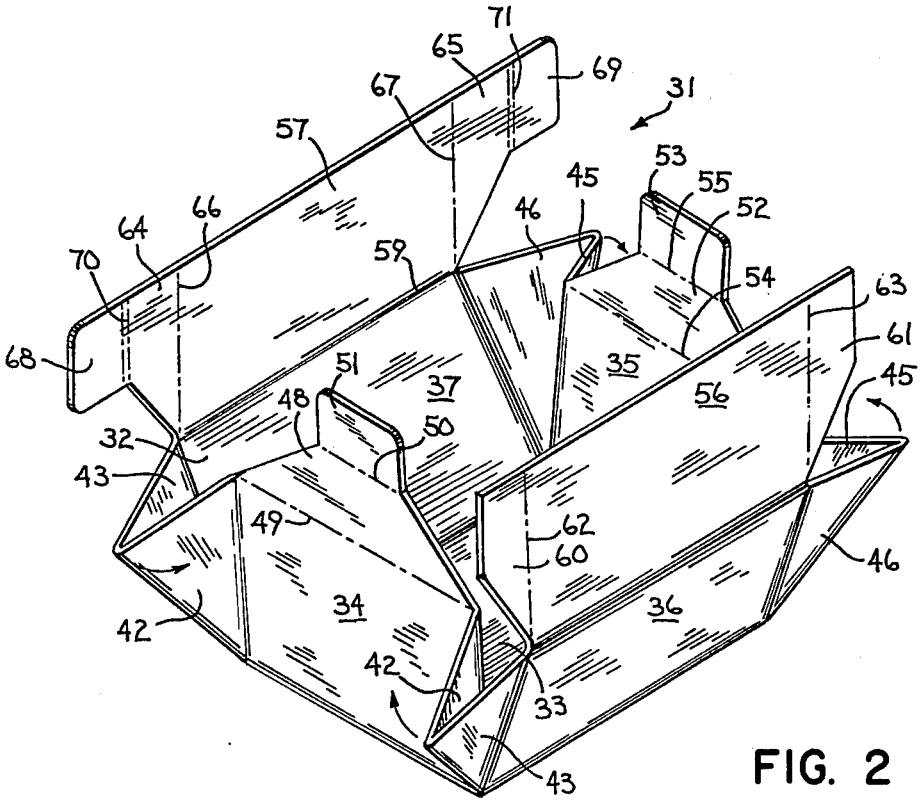
FIG. 2 is an enlarged perspective view showing the blank of FIG. 1 creased along the score lines to generally indicate the manner of folding the blank to form the receptacle.
Figure 3:
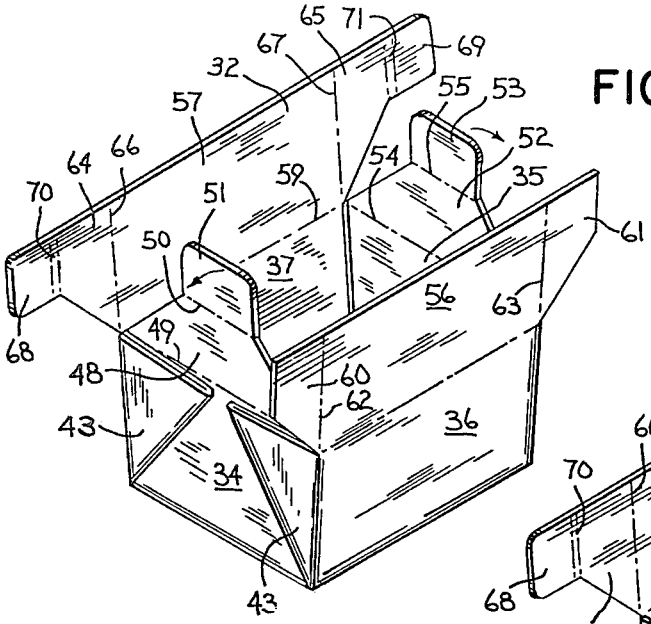
FIG. 3 is a perspective view of the partially folded receptacle showing how the corner gussets are folded in opposed relation along the outside faces of the opposed ends of the receptacle.
Figure 4:
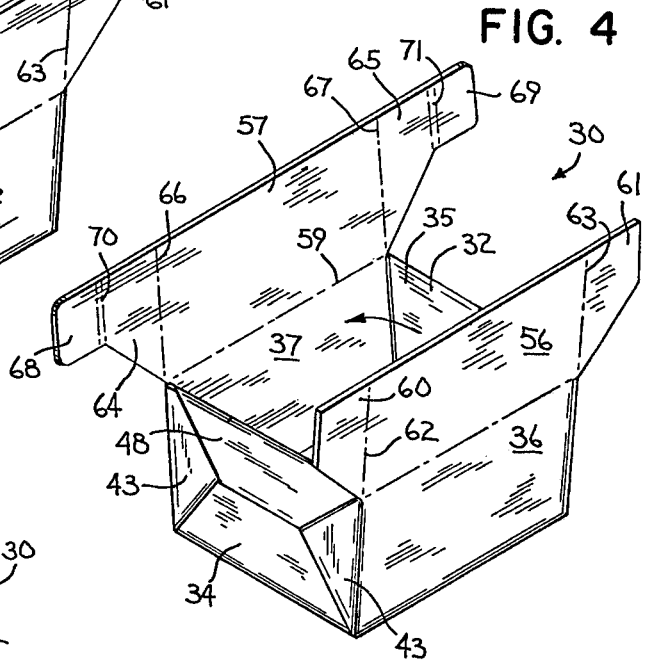
FIG. 4 is a perspective view of the folded receptacle with the first locking tabs in secured position and the cover closure fully open and ready for filling.
Figure 7:
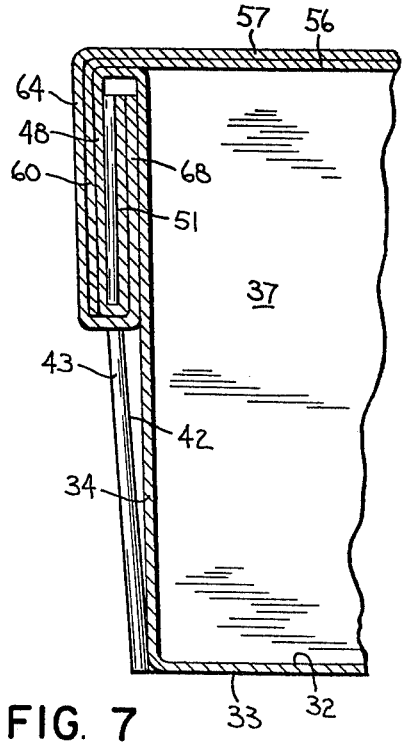
FIG. 7 is a section taken on line 7—7 of FIG. 6 to show in detail the mode of folding at the respective ends of the receptacle to provide for self-locking closure by means of locking tabs and without need for glue, tape or other fastening means.

For fold assembly of the blank 31 to form the receptacle 30, at least the several score lines making up the receptacle proper or an open receptacle are initially creased as generally shown in FIG. 2. In the process of fold assembly, the several gusset corners are all creased on fold lines 44 and 47 to project outwardly of the receptacle 30 as shown in the FIG. 2 illustration. The assembly further requires the corresponding gusset corners to be folded over generally flush against the forward wall 34 and rear wall 35 as generally shown in FIG. 3. Next, the respective forward and rear flaps 48 and 52 are folded outwardly and down on fold lines 49 and 54, respectively, over the corresponding folded gusset corners. To assure a relatively sharp crease along the fold lines 49 and 54, the upper edge of the folded gusset corners taper downwardly relative to the corresponding fold lines 49 and 54 so that the ends of the gusset corners at the extremity of the fold lines 44 and 47 are clearly spaced below the fold lines 49 and 54 as shown in FIG. 3 and so do not materially interfere with the folding or creasing of the latter. With the respective flaps 48 and 52 folded down over the corresponding gusset corners at the front and back of the receptacle 30, the respective tabs 51 and 53 are folded on score lines 50 and 55 and tucked upwardly under the folded gusset corners as generally shown in FIGS. 4 and 7 of the drawings. With the grain of the paperboard running parallel to the length of the receptacle 30 and therefore perpendicular to the fold lines 50 and 55, the respective tabs 51 and 53 will be relatively more stiff in the corresponding direction to resist a curling effect during tucking.

Figure 5:
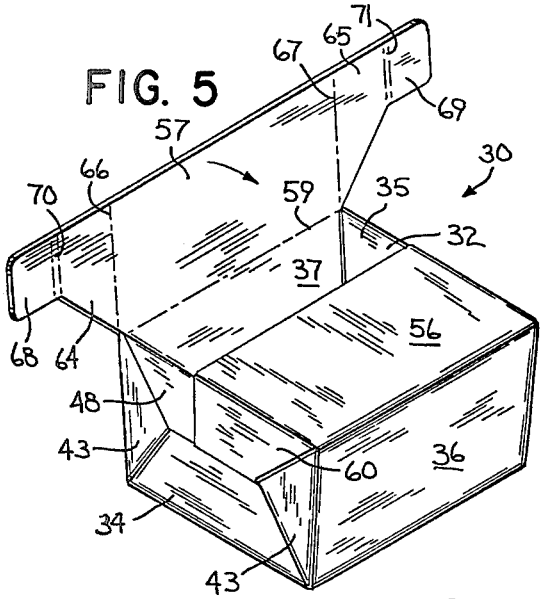
FIG. 5 is a perspective view of the receptacle and shows one of the cover closure flaps in closure position.
Figure 6:
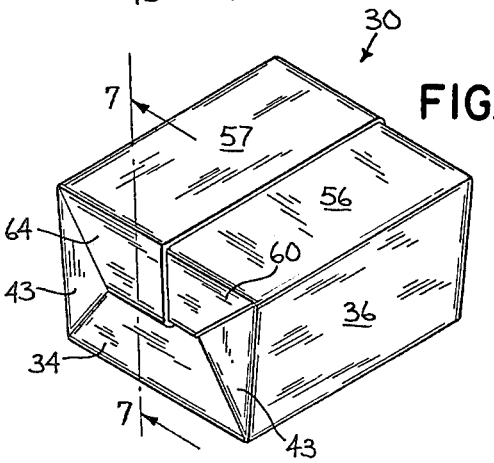
FIG. 6 is a perspective view of the receptacle when fully closed.

To effect closure of the receptacle 30, the cover flap 56 is first folded down onto the top of the receptacle 30 on the score line 58 and the opposed forward and rear extensions 60 and 61 on the cover flap are folded down over the flaps 48 and 52 at the forward and rear walls, respectively, of the receptacle on the fold lines 62 and 63. As shown in FIG. 5, the cover flap 56 extends well beyond the midpoint of the top opening of receptacle 30. Cover flap 57 is then similarly folded down on score line 59 from the opposite side wall 37 of receptacle 30 and overlaps with the end of cover flap 56 to fully cover or enclose the contents of the receptacle. The opposed forward and rear extensions 64 and 65 on cover flap 57 are then folded down over the forward and rear flaps 48 and 52 and in overlapping relation with the extensions 60 and 61 of cover 56 on the fold lines 66 and 67 respectively. The tabs 68 and 69 separated from the opposed extensions 64 and 65 by the double score lines 70 and 71 are then tucked under the corresponding tabs 51 and 53 to provide a lasting, self-locking closure for the receptacle 30 without need for glue, tape or other fastening means. The double score lines 70 and 71 provide for the neat accommodation of the overlap between the cover flaps 56 and 57 and of the earlier tucking fold effected by the tabs 51 and 53 as clearly illustrated in the detail section of FIG. 7. Again, with the grain of the paperboard running parallel to the length of the receptacle 30 and therefore perpendicular to the fold lines 70 and 71, the tabs 68 and 69 are somewhat stiffened to resist curling of the tabs in the tucking operation.

The structure and mode of assembly for the receptacle 30 provides for a generally sturdy and lasting container. The self-contained locking closure provides for a lasting and generally dust free containment. The structure requires no glue, tape, staples or other fastening means which are likely to provide for a slower assembly, give rise to a need for tools when opening the receptacle 30 to discharge its contents at the point of use, and could end up as possible contaminants in the discharged contents.

Figure 8:
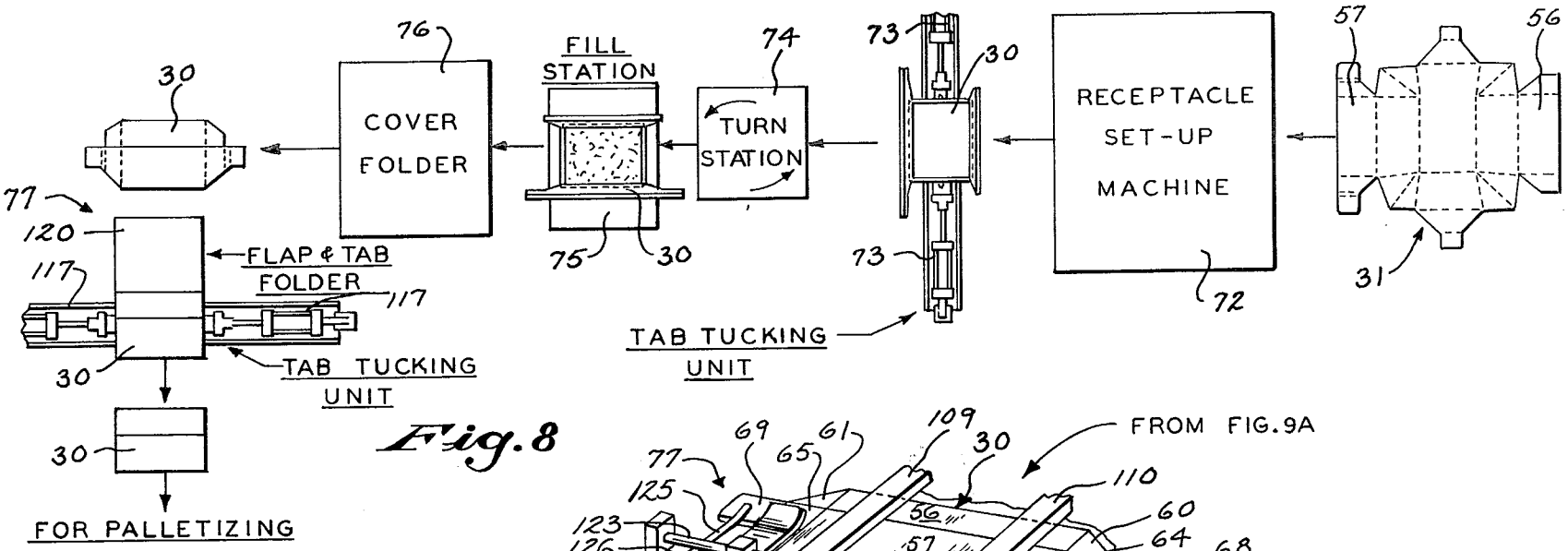
FIG. 8 is a diagrammatic view of the mechanism which starts with the blank of FIG. 1 and provides for mechanical set-up of the receptacle prior to filling, and for mechanical closure of the cover after the filling operation.

Referring now to the arrangement of FIG. 8, the individual blanks 31 are fed into the set-up machine 72 wherein the score lines for the basic container are appropriately creased and the corresponding corner gussets folded in opposed relation against the respective outer faces of the forward and rear walls to generally form up the receptacle to the condition shown in FIG. 3. Additionally, the respective flaps 48 and 52 are folded outwardly on score lines 49 and 54 to present the tabs 51 and 53 in readiness for tucking by the opposed tab tucking units 73. As the formed up receptacle advances past the tucking units 73, the flaps 48 and 52 are folded down and against the corresponding gussets and the respective tabs 51 and 53 are tucked under such gussets in the manner as generally shown in FIG. 4. The tucking units 73 are not further described at this point because they are generally similar to the tucking units as employed for the cover closure tabs 68 and 69 which will hereinafter be described in detail.

The open receptacle 30 as shown in FIG. 4, is next advanced to the turn station 74 where it is mechanically or manually rotated through 90° so that the receptacle will be further advanced lengthwise. After orientation for lengthwise movement, the receptacle 30 is advanced to the fill station 75 to receive its contents. Thereafter the receptacle 30 moves through a cover closure mechanism including a cover folding apparatus 76 and a tab tucking apparatus 77 disposed normal to the folding apparatus.

Figure 9B:
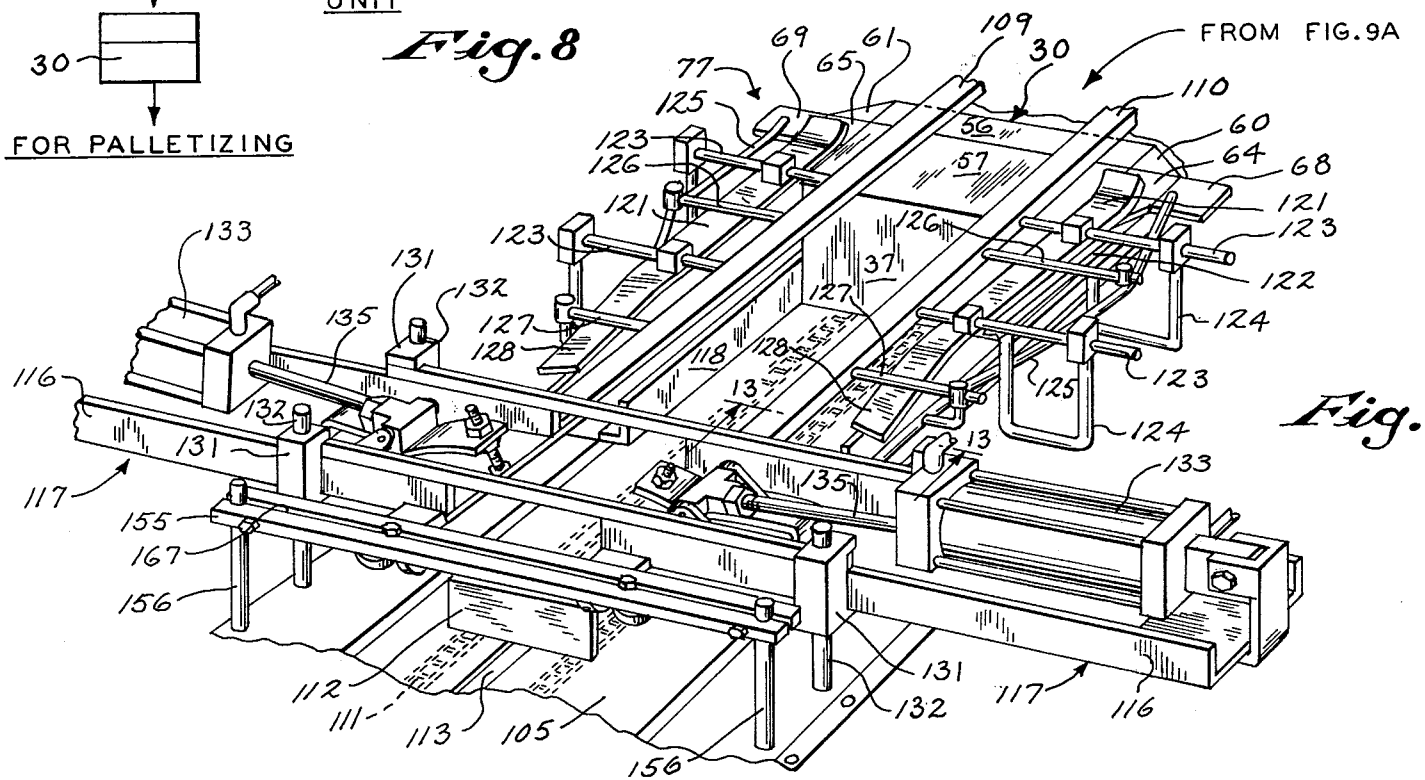
FIG. 9B is a partial perspective view showing the cover flap fold-down and tab tucking apparatus of the cover closure mechanism.

The cover closure mechanism for the receptacle 30 is shown in perspective in FIGS. 9A and 9B and includes an elevated frame 78 supported by a plurality of legs 79.

The infeed end 80 of the cover closure mechanism shown in FIG. 9A includes transversely spaced portions 81 and 82 of a belt conveyor 83 operatively mounted on the frame 78. The upper reaches of the conveyor portions 81 and 82 are disposed above the frame slide surface 84 of the cover folding apparatus 76 and serve to advance the filled but open receptacles 30 between the opposed side rails 85, spaced above the frame slide surface, until their travel is interrupted by the stop 86 which projects upwardly through an opening 87 in the frame between the conveyor portions.

The frame 78 also provides operative support for the chain conveyor 88, the trailing end of which overlaps with the leading end of belt conveyor 83 ahead of the stop 86. The chain conveyor 88 carries a plurality of longitudinally spaced pusher elements 89 which pass through the frame opening 87 when moving from the lower reach to the upper reach of the chain conveyor. Along the upper reach of the chain conveyor 88, the elements 89 move along the longitudinally extending slot 90 in the frame 78 which communicates with the frame opening 87. The pusher elements 89 serve to advance the spaced receptacles 30 over the frame slide surface 84 of the cover folding apparatus 76.

Figures 2A, 10:
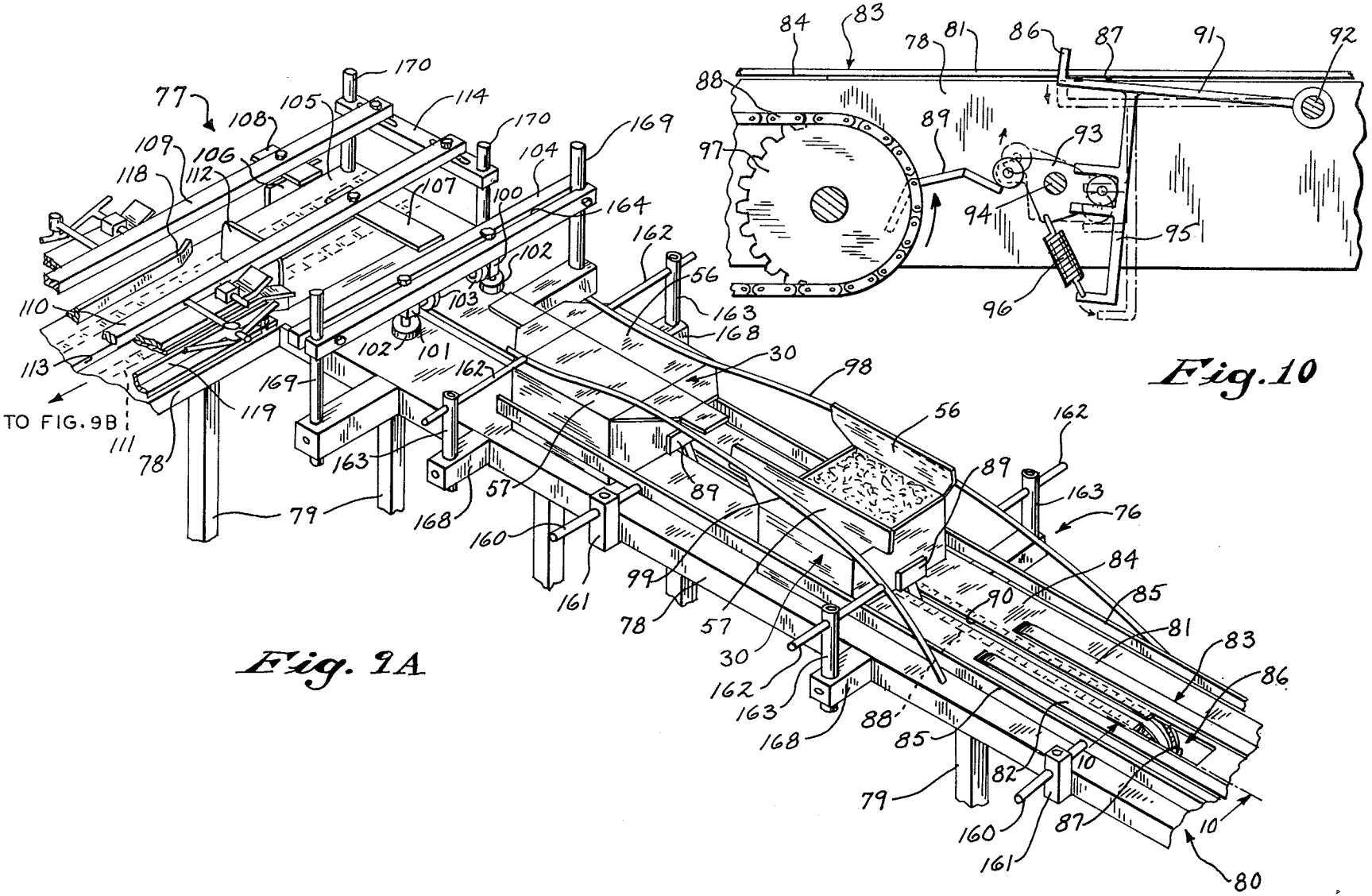
FIG. 10 is a detail view taken generally on line 10—10 of FIG. 9A.

The upwardly projecting stop 86 forms a part of the pivotal release member 91 as generally shown in FIG. 10. Release member 91 is mounted to the frame 78 on the pin 92 and is pivotal to depress the stop 86 and thereby release the next filled receptacle 30 for effecting cover closure. A rocker lever 93 pivoted intermediate its length to the frame 78 on the pin 94 has one end thereof operatively engaged with the downwardly projecting portion 95 of the release member 91 and its other or free end projecting into the path of the pusher elements 89 carried by the chain conveyor 88. A tension spring 96 is disposed between the lower end of the release member portion 95 and the free end of lever 93 and serves to simultaneously bias the release member 91 upwardly to place the projecting stop 86 into its normal position to intercept the receptacles 30 and the free end of the lever 93 downwardly into its normal position in the path of the pusher elements 89.

In operation, succeeding pusher elements 89 of the chain conveyor 88 trained on the sprocket 97 engage with the free end of the lever 93 to rock the lever against the bias of spring 96 to depress the stop 86 and thereby release a receptacle 30. After a given pusher element 89 is carried past the free end of lever 93, the lever and release member 91 are free to resume their normal positions as provided for by the spring 96 when the released receptacle 30 clears the stop 86 and allows the stop to move upwardly to intercept the next adjacent receptacle. Thus, the operation of the release member 91 and its projecting stop 86 to release individual receptacles 30 is in timed sequence with the operation of the chain conveyor 88.

When a receptacle 30 is released from behind the stop 86 by operation of the release member 91, the active belt conveyor 83 carries the released receptacle forwardly onto the slide surface 84 behind the pusher element 89 which effected its release. Thereafter the next following pusher element 89 advances the receptacle 30 through the cover folding apparatus 76.

The cover folding apparatus 76 further includes a pair of transversely spaced, longitudinally extending rods 98 and 99 supported from the frame 78. The rods 98 and 99 are spaced above the frame slide surface 84 to place the rods in engaging relation with the respective cover members 56 and 57 of the advancing receptacles 30. The rods 98 and 99 are appropriately curved to progressively fold the cover members 56 and 57 downwardly on the respective score lines 58 and 59 as the receptacles 30 are advanced by the conveyor pusher elements 89 between the opposed side rails 85. The curved configuration of the rods 98 and 99 further provides that the cover member 56 will reach its full down position over the opening of the receptacle 30 ahead of cover member 57 which includes the locking tabs 68 and 69. As generally shown in FIG. 9A, the cover members 56 and 57 are full down by the time they reach the leading end of rods 98 and 99 which then act as cover hold downs during the continuing advance of the receptacles 30.

Even before the chain conveyor 88 has moved the filled receptacle 30 with the cover members 56 and 57 folded down from beneath the leading end of rods 98 and 99, the receptacle begins a pass beneath and between the transversely spaced pairs or sets 100 and 101 of normally disposed rollers. The roller sets 100 and 101 each comprise a horizontal roller 102 and a vertical roller 103 and are supported from the slotted bar 104 carried by the frame 78. The rollers 102 and 103 of the roller set 100 are adapted to engage with the side 36 and cover member 56 respectively of the receptacle 30 adjacent to the score or fold line 58 to sharpen the crease along that line or edge. The like numbered rollers of the opposed set 101 engage with the side 37 and cover member 57 respectively to similarly sharpen the crease along the score or fold line 59.

After passing through the roller sets 100 and 101 of the cover folding apparatus 76, the chain conveyor 88 advances the filled receptacle 30 onto the slide surface 105 of the tab tucking apparatus 77. As the receptacle 30 approaches the stop 106 on the far side of the apparatus 77, it passes beneath the transversely spaced cover hold-down plates 107 and 108 supported from the longitudinally extending cover hold-down bars 109 and 110. Since the tab tucking apparatus 77 is disposed normal to the cover folding apparatus 76, the receptacle 30 becomes oriented for sidewise travel on the apparatus 77 as provided for by the chain conveyor 111 operatively disposed beneath the slide surface 105 and carrying longitudinally spaced pusher elements 112 which project through and advance relative to the longitudinally extending slot 113 in the slide surface. While the drives for the several conveyors 88 and 111 are not otherwise shown, it should be understood that the pusher elements of the respective conveyors are synchronized to provide that the receptacle 30 arriving adjacent to the stop 106 of the tab tucking apparatus 77 is picked up and advanced clear of the arrival area before the next adjacent receptacle is pushed onto the arrival area from the cover folding apparatus 76.

Figure 11:
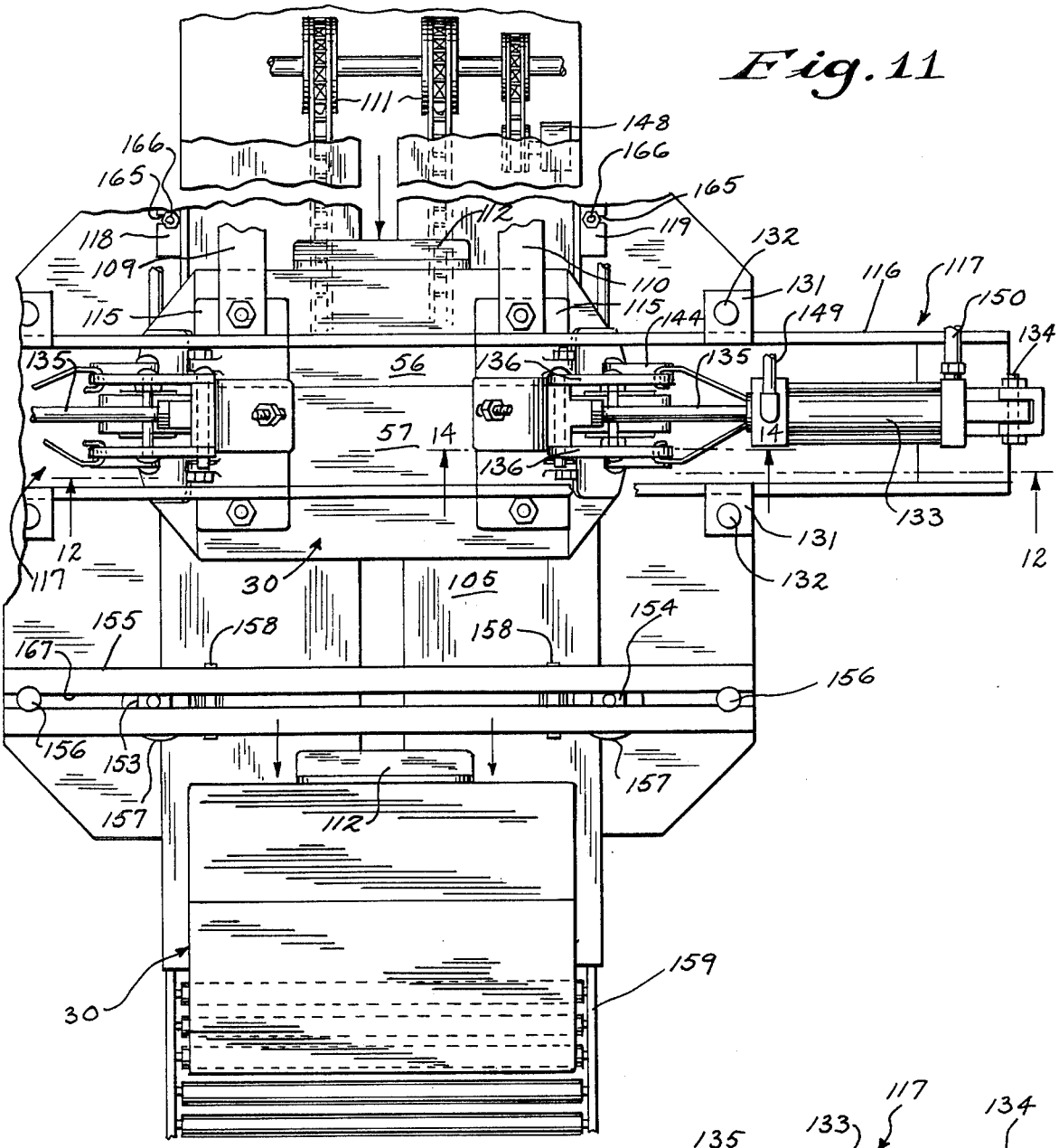
FIG. 11 is a partial plan view of the tab tucking apparatus for the cover closure mechanism with some parts broken away and others removed for clarity.

The transversely spaced, longitudinally extending hold-down bars 109 and 110 of the tab tucking apparatus 77 are supported on the frame 78 at the arrival end of the apparatus by the slotted bar 114 as shown in FIG. 9A. The opposite ends of the respective hold-down bars 109 and 110 are connected to a projection 115 from the frame 116 of a corresponding tab tucking unit 117 as shown in FIG. 11. The receptacle 30 is transversely confined on the tab tucking apparatus 77 by the opposed side rails 118 and 119 secured to the frame 78.

As the filled receptacle 30 arrives at the tab tucking apparatus 77 with the cover members 56 and 57 folded down, the opposed cover flaps 60 and 61 of the cover member 56 remain transversely outstretched with respect to the line of travel on the apparatus 77 (contrary to the showing in FIG. 5 which generally illustrates the preferred manner of manual folding with the flaps 60 and 61 being folded down), as do also the flaps 64 and 65 as well as the corresponding tabs 68 and 69 of cover member 57. After clearing the arrival area on the tab tucking apparatus 77, the receptacle 30 with outstretched cover flaps passes through a cover flap and tab folding section 120 as best shown in FIG. 9B before reaching the opposed tab tucking units 117.

The cover flap and tab folding section 120 includes a pair of vertically spaced, superposed plates 121 and 122 disposed on each side of the apparatus 77 for receiving therebetween the opposed outstretched cover flaps of the advancing receptacle 30. The upper plate 121 on each side of apparatus 77 is supported by a pair of longitudinally spaced and transversely extending rods 123 which extend outwardly from the corresponding cover hold-down bars 109 and 110. The lower plate 122 on each side of the apparatus 77 is also supported by the corresponding hold-down bars 109 and 110 by means of a generally U-shaped bracket member 124 which carries the plate at the upper end of the inner leg of the bracket member while the outer leg is mounted adjacent to the outer end of the corresponding rod. As the receptacle 30 advances on the apparatus 77 with the cover members 56 and 57 folded down, the spaced plates 121 and 122 on each side of the apparatus are adapted to receive therebetween the outstretched cover flaps on the corresponding end of the receptacle to generally provide for vertical confinement of the flaps.

Figure 12:
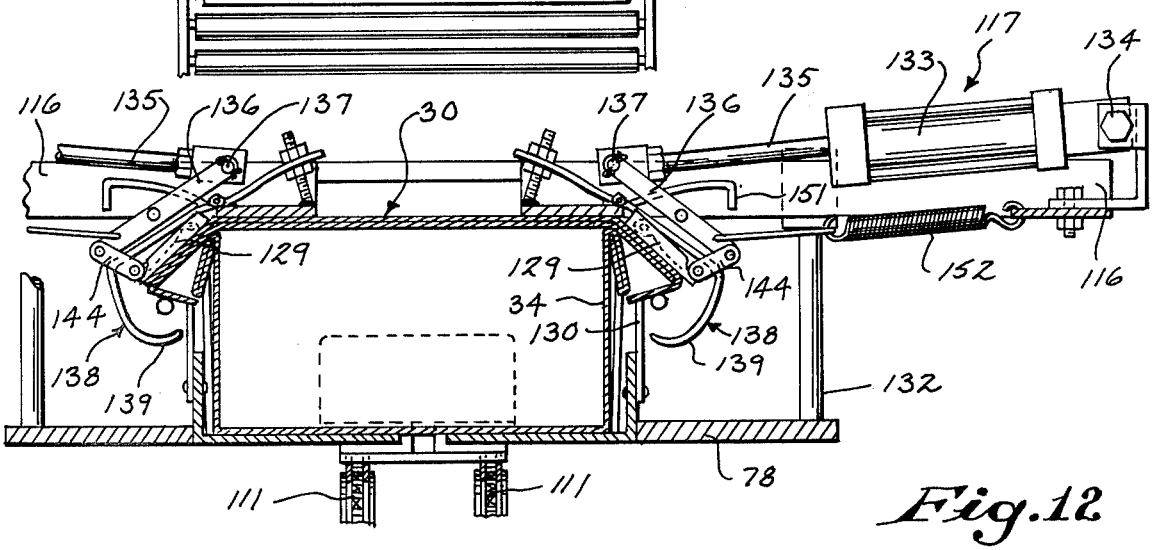
FIG. 12 is a sectional view taken generally on line 12—12 of FIG. 11.
Figure 13:
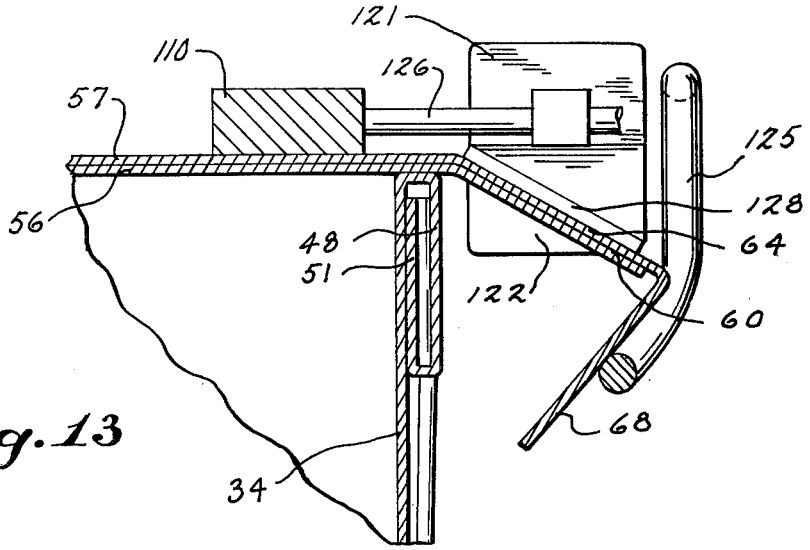
FIG. 13 is a detail view taken generally on the line 13—13 of FIG. 9B.
Figure 14:
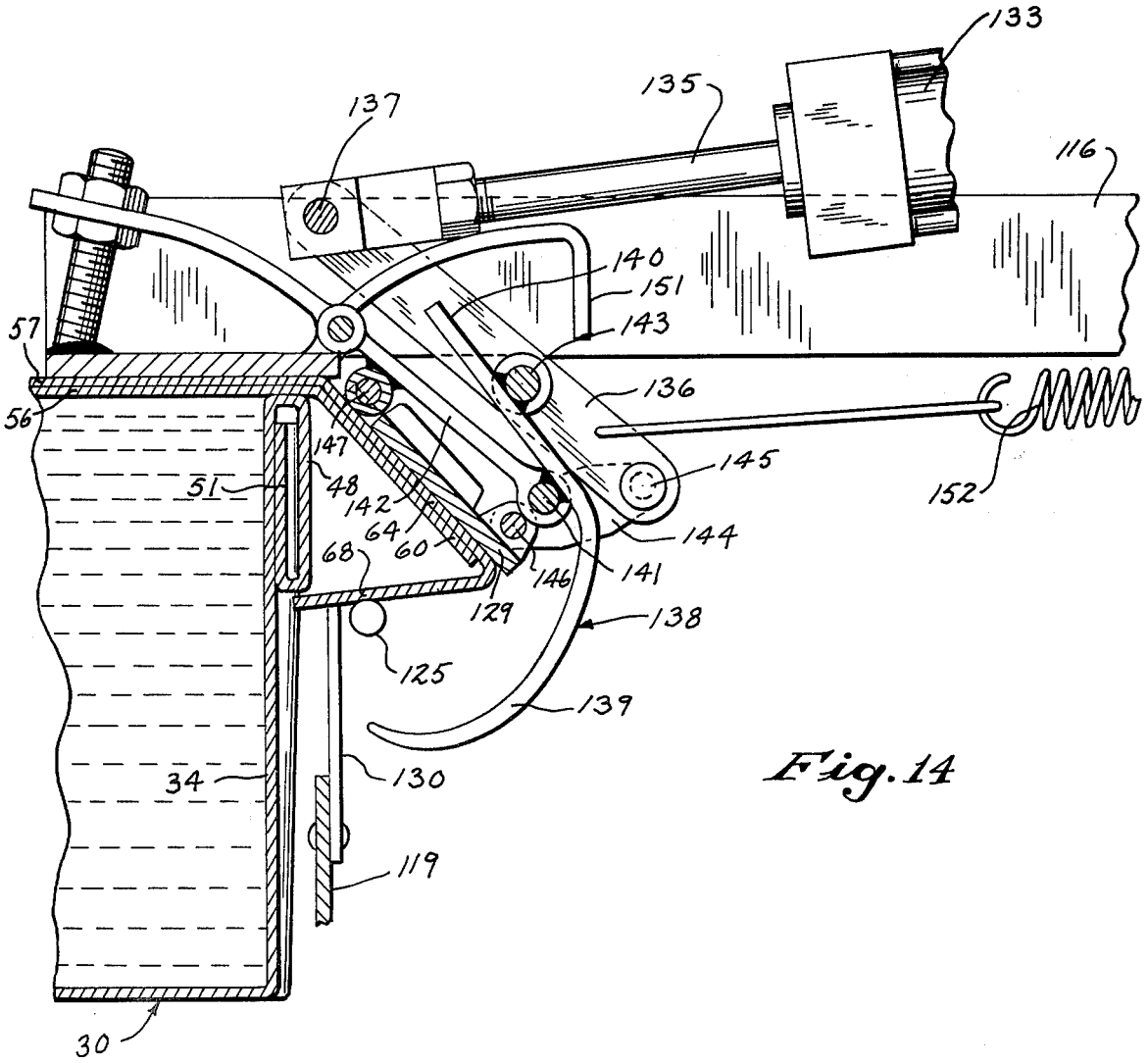
FIG. 14 is an enlarged sectional view taken generally on line 14—14 of FIG. 11 and shows a receptacle in the tab tucking position prior to operation of the tab tucking apparatus.

The opposed cover tabs 68 and 69 on the cover member 57 of receptacle 30 project outwardly beyond the confines of the vertically spaced plates 121 and 122 on each side of the apparatus 77 to engage with the corresponding longitudinally extending rod 125. The rod 125 on each side of the apparatus 77 is also supported from the corresponding hold-down bars 109 and 110 by a pair of longitudinally spaced rods 126 and 127 which extend outwardly from the corresponding hold-down bars. Each rod 125 is curved to provide for folding the corresponding engaging tab 68 or 69 downwardly relative to the vertically confined flaps on the double score lines 70 and 71 during the travel of receptacle 30 and the period of confinement of the cover flaps between the plates 121 and 122. After the tabs 68 and 69 are folded or bent to a condition of being generally normal relative to the cover flaps, the need for confinement of the cover flaps ceases and the lower plate 122 terminates even while the upper plate 121 extends therebeyond. The leading end portion or extension 128 of upper plate 121 which extends beyond the terminus of lower plate 122 is curved or bent to provide for a folding or bending of the corresponding cover flaps with the continuing advance of receptacle 30 as generally shown in FIG. 13. The fold or bend imparted to the cover flaps by the plate extension 128 must provide for subsequent entry of the cover flaps under the pusher plate 129 of the corresponding tab tucking unit 117. In the region of the plate extension 128, the rod 125 generally parallels the curve or bend of the plate extension to maintain the generally normal relation between the respective tabs 68 and 69 and the corresponding cover flaps as generally indicated in FIG. 13. The amount of fold or bend imparted to the cover flaps may be increased somewhat beyond the termination of plate extension 128 and the angle between the respective tabs 68 and 69 and the corresponding cover flaps is reduced to an acute angle by the continuation and upward curvature of the leading end portion of rod 125. The curvature of rod 125 also brings the free end of the tabs into close relation with the corresponding ends of the receptacle 30 as generally shown in FIGS. 12 and 14.

As the tabs 68 and 69 leave the end of rod 125, they are deposited on the corresponding upwardly projecting fingers 130 secured to the frame 78. Even before the tabs 68 and 69 leave the corresponding fingers 130 with continuing advance of the filled receptacles 30, the opposed tab tucking units 117 proceed with their mission as generally shown in sequence in FIGS. 14–16 to effect tucking of the opposed tabs 68 and 69 under the corresponding tabs 51 and 53 as earlier tucked by the opposed tab tucking units 73.

The respective tab tucking units 117 are disposed in opposed relation and extend transversely relative to the line of travel of the receptacles 30. The frames 116 of the units 117 are secured in blocks 131 spaced transversely relative to the tucking unit frame and mounted on vertical posts 132 projecting upwardly from the frame 78.

The tucking units 117, as well as tucking units 73, each comprise a double-acting cylinder-piston assembly 133 having the closed end thereof pivotally mounted on the pin 134 carried at the outer end of frame 116 and the piston rod 135 projecting inwardly. The end of the piston rod 135 is pivotally connected to the upper end of the spaced levers 136 by the pin 137. A J-shaped member 138 having an arcuate, upwardly concave, inwardly extending finger 139 joined to a generally straight portion 140 is pivoted adjacent to the lower end of the straight portion on the pin 141 mounted on the tucker unit frame projection 142. The straight portion 140 of member 138 projects generally upwardly between the spaced levers 136 and is pivotally connected intermediate its length to the levers on the pin 143 which extends between the levers intermediate their length. A linkage member 144 is pivotally connected to the lower end of each lever 136 at the aligned pins 145. The opposite end of the spaced linkage members 144 are pivotally connected on the pin 146 adjacent to the lower edge of the pusher plate 129 which in turn is pivoted adjacent to its upper edge from the frame projection 142 on the pin 147.

Figure 15:
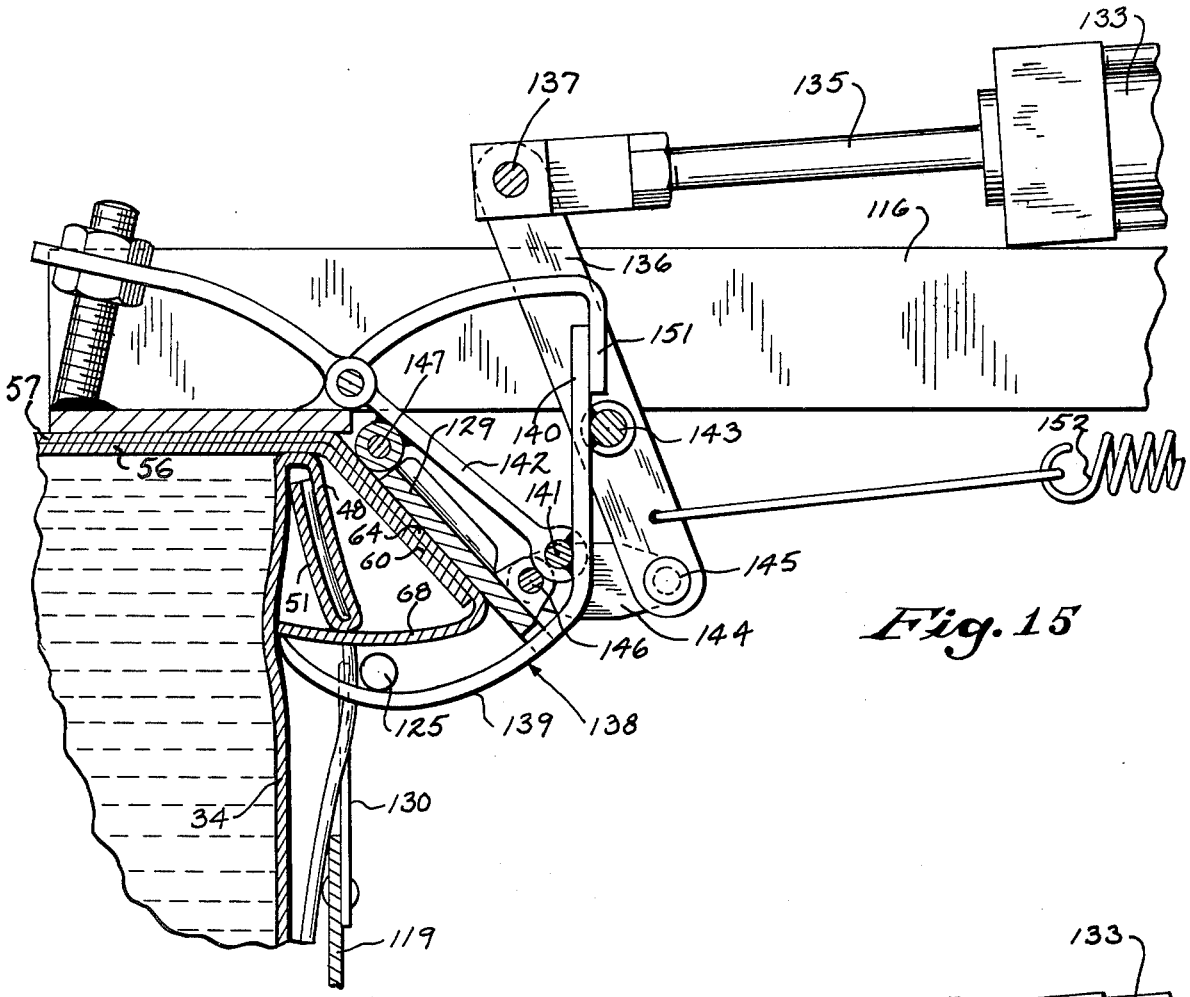
FIG. 15 is a view generally similar to that of FIG. 14 and shows the tab tucking apparatus at an intermediate stage of its operation.
Figure 16:
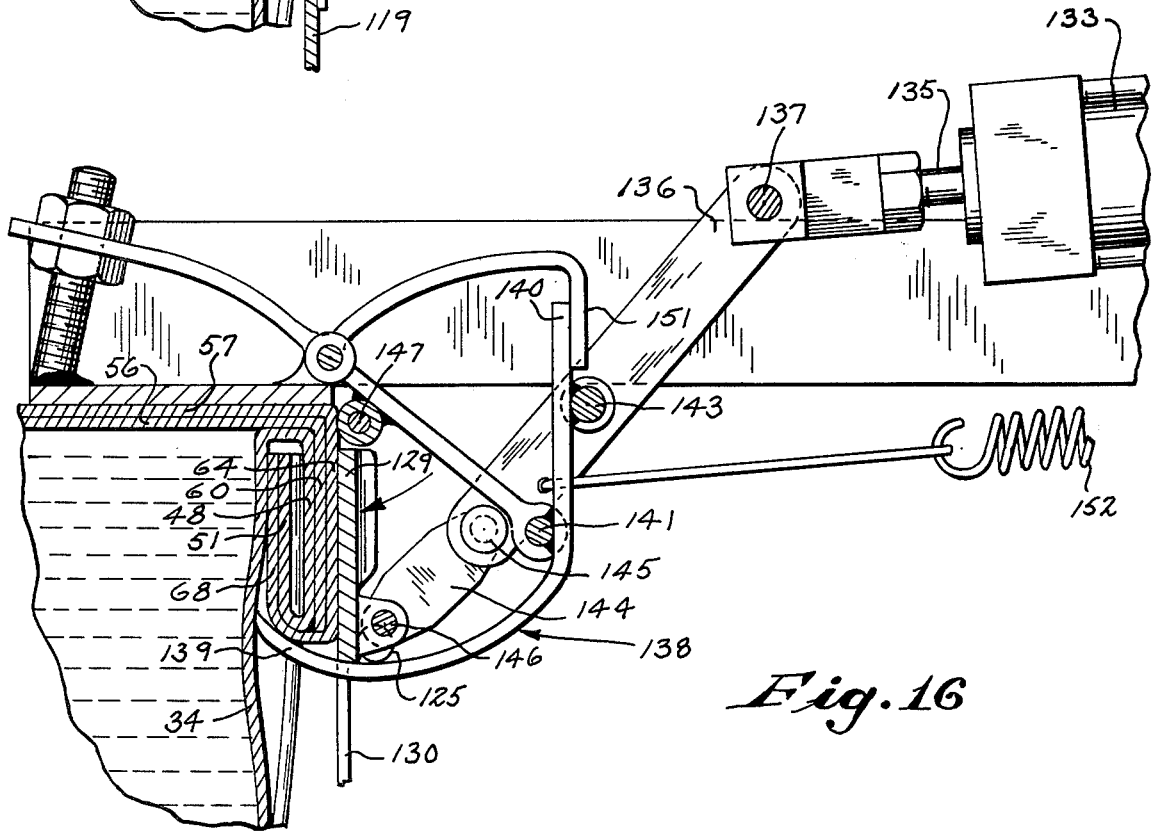
FIG. 16 is a view generally similar to that of FIG. 14 and shows the tab tucking apparatus at the conclusion of the tab tucking operation.

Operation of the tab tucking units 117 is controlled by a timing micro-switch 148 associated with the chain conveyor 111 to provide for actuation of appropriate valves, not shown, in the supply lines 149 and 150 for the cylinder-piston assemblies 133 from a pressure source, not shown. With the arrival of a receptacle 30 in the tab tucking station, the cylinder-piston assemblies 133 of the opposed tucking units 117 are initially contracted by pressure flow in the lines 149 as provided for by the operation of switch 148. With reference to FIGS. 14 and 15, the initial portion of the contraction of the cylinder-piston assembly 133 causes the levers 136 and associated linkage members 144 to generally pivot on the pin 146 relative to the pusher plate 129 which remains motionless. During the initial movement of the levers 136 by contraction of the cylinder-piston assembly 133, the pivotal connection 143 to the J-shaped member 138 is carried clockwise to pivot the J-shaped member correspondingly relative to the frame projection 142 on the pin 141. Pivotal movement of the J-shaped member 138 is interrupted when the upper end of the straight portion 140 thereof engages with a frame projection stop 151. Meanwhile the arcuate finger 139 of member 138 has pivoted to engage with and pick up the corresponding tab 68 from the frame projecting finger 130 and carry the free end of the tab upwardly adjacent to the outer face of the end 34 of the moving receptacle 30, with an intermediate portion of the tab bearing upwardly against the juncture of tab 51 and flap 48 to impart a slight upwardly concave curvature to the tab 68. With the pivotal movement of the J-shaped member 138 interrupted by the stop 151, the levers 136 are now caused to pivot on the pin 143 with continued contraction of the cylinder-piston assembly 133. The pivotal movement of the levers 136 on the pivot pin 143 causes the pusher plate 129 to pivot inwardly toward the receptacle 30 and the consequent bearing pressure on the cover flap 64 effects a camming of the tab 68 upwardly into tab locking position between the outer face of the receptacle end 34 and the tab 51 as generally shown in FIG. 16.

Immediately after the tucking of tab 68 is accomplished, the cylinder-piston assembly 133 is extended by the admission of pressure fluid in supply line 150. The tension spring 152 disposed between the lower end of the levers 136 and an outer end portion of the tucker frame 116 assures initial pivotal movement of the levers 136 on the pin 143 with extension of the cylinder-piston assembly 133 to first return the pusher plate 129 generally to its position as shown in FIG. 15. With the pusher plate 129 fully withdrawn, the levers 136 and linkage members 144 together pivot on the pin 146 to effect a counterclockwise motion of the J-shaped member 138 on the pin 141 and withdrawal of the finger 139 with continued extension of the cylinder-piston assembly 133. With full extension of the cylinder-piston assembly 133, the tab tucking unit 117 is restored to the condition as generally shown in FIG. 14 in readiness for the next receptacle 30.

It should be understood that the tab tucking operation is performed while the receptacles 30 remain in motion and must be accomplished in the relatively short interval represented generally by the length of the score or fold lines 50 and 55 moving past the J-member finger 139 of the opposed units 117. The full operational cycle of units 117 to effect tucking of the corresponding tab and then withdrawal requires but a fraction of a second.

As the filled and closed receptacle 30 is advanced beyond the tab tucking units 117 by the chain conveyor 111, it approaches and passes through the opposed roller sets 153 and 154 supported in spaced relation above the slide surface 105 by the slotted bar 155 mounted on the transversely spaced frame posts 156. The roller sets 153 and 154 each comprise a horizontal roller 157 and a vertical roller 158 generally similar to the roller sets 100 and 101 of the cover folding apparatus 76. The opposed roller sets 153 and 154 are adapted to sharpen the creases along the opposed upper edges of the receptacle 30 formed by the cover flap fold or score lines 67 and 63 at the one end and the cover flap fold or score lines 66 and 62 at the other end.

After passing through the opposed roller sets 153 and 154, the chain conveyor 111 deposits the filled and closed receptacles 30 on the roller conveyor 159 from which the receptacles are removed for palletizing or other storage.

The receptacles 30 come in various sizes depending on product volume or weight to be contained. Thus, the apparatus for set-up and closure must be adjustable if different sizes of receptacles 30 are to be filled from time to time.

For adjustment of the cover folding apparatus 76 to accommodate a receptacle 30 of different width, the opposed side rails 85 are each supported by a pair of outwardly extending longitudinally spaced, horizontal rods 160 that are transversely movable relative to the corresponding blocks 161 carried by the frame 78. The opposed cover fold-down rods 98 and 99 are each similarly supported by a pair of outwardly extending longitudinally spaced, horizontal rods 162. The rods 162 are transversely movable relative to the corresponding posts 163 through which the rods extend to accommodate the desired width. For change in width, the only other adjustment necessary on the cover folding apparatus 76 is to vary the lateral spacing between the roller sets 100 and 101 within the slot 164 of the supporting bar 104. For accommodation of receptacles 30 of different width, change is ordinarily unnecessary on the tab tucking apparatus 77.

For variation in length of the receptacle 30, change is ordinarily unnecessary on the cover folding apparatus 76. On the tab tucking apparatus 77, however, the opposed side rails 18 and 119 are transversely movable on the frame 78 by virtue of the accommodating slots 165 in the side rails members for the fastening members 166. Also required for length variation is transverse movement of the tab tucking units 117 and the several elements comprising the cover flap and tab folding section 120. To effect such movement, the units 117 are loosened relative to the support blocks 131 and the cover hold-down bars 109 and 110 are loosened relative to the slotted bar 114. When rendered movable, the cover hold-down bar 109 and corresponding tab tucking unit 117 are movable together transversely as are also the cover hold-down bar 110 and its corresponding tab tucking unit 117. With transverse movement of the bars 109 and 110 to accommodate receptacles 30 of different length, the corresponding plates 121 and 122 along with rod 125 for folding the cover flaps and corresponding tab are similarly moved since they are supported from the respective cover hold-down bars. In the event that transverse adjustment is necessary between the respective plates 121 and 122 or between such plates and the corresponding cover hold-down bars 109 and 110, lateral adjusting movements can be made on the support rods 123. Similar lateral adjusting movements for the tab bending rod 125 relative to the corresponding cover hold-down bars 109 and 110 can be made on the support rods 126. The roller sets 153 and 154 are also movable transversely in the slot 167 of the supporting bar 155 to accommodate a length variation in the receptacles 30.

To accommodate a variation in height for the receptacle 30, adjustment is necessary on both the cover folding apparatus 76 and the tab tucking apparatus 77. On the cover folding apparatus 76, the posts 163 supporting the cover fold-down rods 98 and 99 are vertically adjustable relative to the frame projections 168 for mounting the posts. Also, the slotted bar 104 supporting the roller sets 100 and 101 is vertically adjustable relative to the transversely spaced posts 169 on which the bar is mounted.

For accommodating a variation in height for the receptacles 30 on the tab tucking apparatus 77, the tab tucking units 117 and corresponding cover hold-down bars 109 and 110 may be adjusted vertically as an assembly. For such vertical adjustment, the blocks 131 supporting the tab tucking unit 117 are movable on their posts 132, and the slotted bar 114 supporting the remote ends of the cover hold-down bars 109 and 110 is movable on the transversely spaced frame posts 170. On the apparatus 77, the slotted bar 155 mounting the roller sets 153 and 154 is also vertically movable relative to its transversely spaced posts 156. Thus, the cover closure mechanism for the receptacles 30 is fully adjustable within desired limits.

Various modes of carrying out the invention are contemplated as being within the scope of the following claims particularly pointing out and distinctly claiming the subject matter which is regarded as the invention.

We claim:

1. In an arrangement for filling a receptacle having opposed end walls and opposed side walls and formed from a scored blank, said receptacle and blank therefor providing for self-contained closure means including a cover member having endwise extensions disposed on each of the opposed side walls, means for folding the scored blank and setting up the receptacle with the cover members in open relation, means for presenting the open receptacle to the fill station and oriented with the side walls paralleling the subsequent directon of travel, first conveyor means for moving the filled receptacle, cover member fold-down means spaced above and extending longitudinally of the first conveyor means for folding the opposed cover members down into receptacle closure position with travel on said first conveyor means, second conveyor means disposed normal to the first conveyor means and adapted to receive the receptacle from the first conveyor means with cover members in closure position, said receptacle being oriented on said second conveyor means for travel with the end walls paralleling the direction of travel, and means associated with said second conveyor means for locking the endwise extensions on said cover members relative to the receptacle end walls to secure the cover members in closure position.

2. The structure as set forth in claim 1 wherein the first conveyor means is a chain conveyor having longitudinally spaced pusher elements for advancing corresponding receptacles, and infeed means for said chain conveyor and including a releasable stop for interrupting the advance of the receptacles, said stop being releasable in timed relation with operation of the chain conveyor to provide for the infeed of receptacles onto the chain conveyor at a rate not to exceed the capacity of said conveyor.

3. The structure as set forth in claim 2 wherein the releasable stop carried by a pivotal member normally biased to place the stop in position to interrupt the flow of receptacles onto the chain conveyor, means operably associated with the pivotal member to move the stop to the receptacle release position, said means being engageable by the pusher elements of the chain conveyor to provide for the infeed of receptacles onto the chain conveyor corresponding to the pusher elements.

4. The structure as set forth in claim 1 wherein the cover member fold-down means comprise an elongated member corresponding to each cover member, said elongated members being appropriately curved over at least a portion of their length to provide for progressive folding of the cover members to the closure position as the receptacle is advanced by the first conveyor means.

5. The structure as set forth in claim 4 wherein the elongated members are adjustable laterally and vertically to accommodate a run of receptacles of different lateral and/or vertical dimensions.

6. The structure as set forth in claim 1 wherein a pair of normally disposed rollers engage with each cover member and corresponding side of the receptacle adjacent to the fold line therebetween to sharpen the crease on the fold line as the receptacle advances on the first conveyor means after passing through the cover member fold-down means.

7. In an arrangement for effecting closure of a receptacle having opposed end walls and opposed side walls normal to said end walls, said end walls each hving a downwardly opening pocket on the outer face thereof, said receptacle including self-contained closure means comprising a cover member disposed on each of the side walls and having opposed endwise flap extensions with each flap extension on one of said cover members further having an endwise projecting locking tab, said cover member having the locking tabs being adapted to overlie at least a portion of the opposed cover member in the receptacle closure position, said arrangement including means for folding the opposed cover members down in proper sequence into the receptacle closure position with the flap extensions remaining outstretched, means for supporting the cover flap extensions in the outstretched position, means for folding the locking tabs downwardly generally normal to the flap extensions while the latter are supported in the outstretched position, means for folding the cover flap extensions downwardly and angularly relative to the receptacle end walls while maintaining the generally normal relation between the locking tabs and the flap extensions, means for folding the locking tabs to form an acute angle relative to the flap extensions and placing the free end thereof adjacent to and beneath the opening of the corresponding end wall pockets, means for engaging and carrying the free end of the locking tabs into the corresponding end wall pocket opening with an intermediate portion of the locking tabs bearing upwardly against the edge of said pocket, and means for bearing on the flap extensions to cam the locking tabs fully into the respective pockets to provide for locking closure of the cover members.

8. The structure as set forth in claim 7 wherein the means for folding the opposed cover members down in proper sequence into the receptacle closure position comprise a chain conveyor having pusher elements for advancing the receptacle in endwise relation, and a cover member fold-down rod corresponding to each cover member and extending longitudinally with respect to and in spaced relation above the conveyor, said rods being appropriately curved over at least a portion of their length to provide for progressive folding of the cover members to the closure position as the receptacle is advanced by the conveyor.

9. The structure as set forth in claim 8 wherein the cover fold-down rods are adjustable laterally and vertically to accommodate a run of receptacles of different lateral and/or vertical dimensions.

10. The structure as set forth in claim 7 wherein the means for supporting the cover flap extensions in the outstretched position comprise a pair of vertically spaced plates aligned with the flap extensions.

11. For use with a receptacle having a locking tab projecting from a flap extension, said locking tab and flap extension being foldable relative to the receptacle and to each other with the locking tab being insertable into pocket means on the outer face of a wall of the receptacle to provide for its securement, a tucking mechanism for inserting the locking tab into the receptacle pocket means while the receptacle is restrained verticlly and against movement normal to the pocket means, the locking tab and flap extension being initially folded to a position placing the free end of the locking tab adjacent to and beneath the opening of the pocket means with the flap extension disposed angularly and downward relative to the wall containing the pocket means, comprising a frame, a pusher bar having its upper end pivotally connected to the frame and being engageable with the flap extension, lever means pivotally connected adjacent to the lower end of the pusher bar on a first pivot, and a tab positioning member having a generally straight portion and an arcuate portion and being pivotally connected to the frame generally intermediate said portions, said arcuate portion of the tab positioning member being engageable with the locking tab and said straight portion being engageable with a frame stop, said straight portion of the tab positioning member being pivotally connected on a second pivot to an intermediate portion of the lever means, said lever means being initially pivotally movable on said first pivot to carry the second pivot and thereby pivot the tab positioning member to engage the arcuate portion thereof with the locking tab and carry the free end of said locking tab into the opening of the pocket means with an intermediate portion of the locking tab bearing upwardly against the edge of the pocket means while the straight portion of the tab positioning member engages with the frame stop, and thereafter said lever means being further pivotally movable on said second pivot to bear against the first pivot and thereby pivotally move the pusher bar and flap extension to cam the locking tab into the pocket means.

12. The structure as set forth in claim 11 wherein the lever means comprise a lever member and a linkage member which are pivotally connected.

13. The structure as set forth in claim 11 wherein the lever means are actuated by a cylinder-piston assembly.

14. In an arrangement for filling a receptacle having opposed end walls and opposed side walls normal to said end walls and formed from a scored blank, said receptacle and blank therefor including self-contained closure means comprising a cover member disposed on each of the side walls and having opposed endwise flap extensions with each flap extension on one of said cover members further having an endwise projecting locking tab, said cover member having the locking tabs being adapted to overlie at least a portion of the opposed cover member in the receptacle closure position, said arrangement providing for feeding individual blanks into a receptacle set-up machine, forming the receptacle with a downwardly opening pocket on the outer face of the end walls and with the cover members open, presenting the open receptacle to the fill station in readiness for movement with the side walls paralleling the direction of travel, filling the open receptacle, folding the cover members down in proper sequence into the receptacle closure position with endwise movement of the receptacle beneath cover fold-down members, folding the cover flap extensions and projecting locking tabs relative to the receptacle to place the free end of the locking tabs adjacent to the opening of the corresponding receptacle end wall pockets by sidewise movement of the receptacle past flap extension and locking tab folding members, carrying the free end of the locking tabs into the corresponding end wall pocket openings with an intermediate portion of the tabs bearing upwardly against the edge of the pockets, and bearing against the flap extensions to cam the locking tabs into the corresponding pockets to provide for a lasting closure of the filled receptacle.

15. In an arrangement for effecting closure of a receptacle having opposed end walls and opposed side walls normal to said end walls, said end walls each having a downwardly opening pocket on the outer face thereof, said receptacle including self-contained closure means comprising a cover member disposed on each of the side walls and having opposed endwise flap extensions with each flap extension on one of said cover members further having an endwise projecting locking tab, said cover member having the locking tabs being adapted to overlie at least a portion of the opposed cover member in the receptacle closure position, said arrangement providing for folding the opposed cover members down in proper sequence into the receptacle closure position with the flap extensions remaining outstretched, supporting the cover flap extensions in the outstretched position while folding the locking tabs downwardly generally normal to the flap extensions, folding the cover flap extensions downwardly and angularly relative to the receptacle end walls while maintaining the generally normal relation between the locking tabs and the flap extensions, folding the locking tabs to place the free end thereof adjacent to and beneath the opening of the corresponding end wall pockets, carrying the free end of the locking tabs into the corresponding end wall pocket opening with an intermediate portion of the tabs bearing upwardly against the edge of the pockets, and bearing against the flap extensions to cam the locking tabs into the corresponding pockets to provide for a lasting closure of the receptacle.

* * * * *

UNITED STATES PATENT AND TRADEMARK OFFICE

CERTIFICATE OF CORRECTION

PATENT NO. : 4,196,563

DATED : April 8, 1980

INVENTOR(S) : Gabrielson et al

It is certified that error appears in the above-identified patent and that said Letters Patent are hereby corrected as shown below:

Column 10, Line 22, Cancel "18" and substitute therefor ----118---
Claim 7, Column 12, Line 8, Cancel "hving" and substitute therefor ----having----

Signed and Sealed this

*Twelfth* Day of *August 1980*

[SEAL]

*Attest:*

SIDNEY A. DIAMOND

*Attesting Officer*

*Commissioner of Patents and Trademarks*